United States Patent [19]

Wilmers et al.

[11] 3,941,525

[45] Mar. 2, 1976

[54] INTERNAL SEAL FOR THE PISTON OF A ROTARY PISTON ENGINE

[75] Inventors: Gottlieb Wilmers, Neuenstadt; Gerhard Maurhoff, Neckarsulm, both of Germany

[73] Assignees: Audi NSU Auto Union Aktiengesellschaft, Neckarsulm, Wurttemberg; Wankel GmbH, Lindau (Bodensee), both of Germany

[22] Filed: June 21, 1974

[21] Appl. No.: 481,867

[30] Foreign Application Priority Data

June 23, 1973 Germany ..... 2332071

[52] U.S. Cl. ..... 418/142

[51] Int. Cl.[2] F01C 19/08; F04C 27/00; F02B 55/04

[58] Field of Search ..... 418/142; 123/8.01

[56] References Cited

UNITED STATES PATENTS

| | | | |
|---|---|---|---|
| 3,168,237 | 2/1965 | Paschke | 418/142 |
| 3,179,331 | 4/1965 | Paschke et al. | 418/142 |
| 3,396,708 | 8/1968 | Tado | 418/142 |
| 3,718,412 | 2/1973 | McCormick | 418/142 |

*Primary Examiner*—John J. Vrablik

*Attorney, Agent, or Firm*—Kane, Dalsimer, Kane, Sullivan and Kurucz

[57] ABSTRACT

A rotary piston engine of the trochoid type is provided with a housing having two end pieces and a shell having a multi-arcuate interior surface in which the piston is rotatably mounted on the eccentric of an eccentric shaft. An internal seal for the piston includes at least one scraper ring arranged to be axially movable in a concentric annular groove in one face of the piston, revolving with the piston, and pressed by spring action against the adjacent end wall of the housing.

12 Claims, 14 Drawing Figures

INTERNAL SEAL FOR THE PISTON OF A ROTARY PISTON ENGINE

BACKGROUND OF THE INVENTION

Scraper rings are intended to seal the piston of a rotary piston engine in relation to the end wall of the housing so as to prevent coolant or lubricant from passing radially outward into the working chamber. To perform this function known scraper rings act essentially to scrape off the oil adhering to the end wall of the housing and bring it back radially inwardly. For this purpose, the scraper rings on their face adjacent to the end wall of the housing exhibit at least one concentric annular scraping edge, generally sharp edged radially inwardly, while a flat bevel is provided radially outwardly. Owing to this conformation, in centrifugal movements of the scraper ring in a radially outward direction the oil clinging to the end wall of the housing is run over through formation of a hydro-dynamic supporting wedge, and in centripetal movements it is scraped off and brought back radially inwardly.

In known manner, the scraper ring revolving with the piston traverses equal areas of the end wall of the housing inwardly and outwardly alternately in the course of a full revolution. In the phase of inward-directed motion the scraper ring will indeed scrape the traversed area clear, but some of the oil brought inwardly may cling along the scraping edge assisted by centrifugal forces. Now, although a certain quantity of oil may be circulating radially within the scraper ring in the ensuing phase of outward-directed motion the scraper ring must lift off, running over and bring back more oil clinging to the end wall of the housing despite the oil being entrained centrifugally outwardly. It follows from this cycle that if the design of the scraping edge is not efficient, dependable functioning of a scraper ring will cease to be assured. A durable and dependable seal will therefore depend very substantially on the conformation of the scraping edge; it may also be adversely affected by manifestations of wear and dimensional errors, as well as by warping of the end wall of the housing.

SUMMARY OF THE INVENTION

The object of the invention is to provide an internal seal for a piston of a rotary piston engine that shall be capable of bringing the oil adhering to the end wall of the housing predominantly radially inwardly, and of performing its function as a sealing member at all times, even in case of dimensional divergences between the piston and the end wall of the housing.

This object is accomplished, according to the invention by having the scraper ring exhibit spaced scraper edge segments evenly distributed over the circumference of the scraper ring and in contact with the adjacent end wall of the housing, which segments are set oblique radially outwardly in the direction of rotation of the piston.

Thus, the scraper ring can effectively sweep a comparatively extensive region of the end wall of the housing in its inward movement and run over the end wall of the housing without lifting off because of the clear intervals formed between the scraper ring segments in its outward movement. Even in case of manifestations of wear and dimensional inaccuracies of the scraper ring or the end wall of the housing, the scraping edge segments are able to perform their function unimpaired.

The oblique setting of the scraping edge segments relative to the perpendicular central rays of the scraper ring is expediently chosen such that even scraper ring segment is so arranged that in its outward motion from its position nearest the axis, it stands approximately tangential to the epitrochoid being described by it. The result of this is that it is only in this position and in the brief phase following that the scraping edge segments run over a narrow area of the end wall of the housing in the direction of the epitrochoid being described, i.e. radially outwardly without pushing oil adhering to the end wall of the housing radially outwardly, while in the remaining region of the end wall of the housing, viz. even during the ensuing outward motion they can perform a transporting function directed radially inward. The oblique setting of the scraping edge segments can thus have the favorable result that the scraper ring can strip clinging oil off the end wall of the housing and transport it radially inwardly during the predominant portion of its cycle of motion.

The oil stripped off the end wall of the housing by the scraping edge segments may, however, owing to the centrifugal forces at work creep outward on the insides of the obliquely set scraping edges. To avoid this insofar as possible the scraping edge segments of the scraper ring may each be provided at the radially outer end with a hook-shaped projection directed radially inwardly. The oil stripped off may thus be retained by the hooked end of each individual scraping edge segment, detach itself from the scraper ring by inertia from the scraper ring in its phase of inward-direction motion in the region of its position nearest the axis, and drain off inwardly. If any oil nevertheless passes radially outward by way of a scraping edge segment, it can be picked up by the next scraping edge segment during the revolution owing to the mutual overlap.

For purposes of fabrication simplicity the scraper ring may consist of a flat metal strip folded into a zigzag shape. The star shape thus formed depending on the direction of rotation, may have the scraper edge segments on the face side of its elements directed obliquely inwardly, while the neighboring elements directed outwardly which have no transporting function to perform, may be cut back on the face side.

Alternatively an embodiment contemplated by this invention might have the scraper ring consisting of a flat ring, and the scraper edge segments formed by a rib-like elevations on one face of the ring. In this modification the profile of the scraping edge segments in contact with the end wall of the housing may be produced by machining out of solid stock, or alternatively by forging, pressing or sintering, in which latter cases a saving of machine shop work may result.

Another proposed solution provides that the scraper ring consist of a flat ring having tabs separated from each other by indentations on its outer or inner strip, running perpendicular to the plane of the ring towards the adjacent end wall of the housing, their outer edges directed oblique to the direction of rotation of the piston and forming the scraping edge segments. In this embodiment, the scraper ring may consist of a sheet metal strip formed into a ring and bearing the scraping edge segments. A scraper ring produced in this way can adapt itself with special advantage to possible unevennesses in the end wall of the housing, because of its articulated character.

In order to maintain an effective seal even when the engine is not running despite the use of a scraper ring with scraping edge segments between the end wall of the housing and the piston, it is provided that the scraper ring may have an uninterrupted annular scraping edge radially outside or inside for scraping edge segments. The annular scraper edge may, for example, be formed by an additional flat ring arranged in the annular groove, its narrow face side in sealing contact with the end wall of the housing.

Alternatively, however, such auxiliary seal may be provided by turning up the inner or outer edge of the sheet metal ring towards the adjacent end wall of the housing to form the uninterrupted annular scraping edge.

According to the invention, it is further provided that the scraper ring with its scraping edge segments may be arranged in a supporting ring of U-shaped cross-section open towards the adjacent end wall of the housing, with at least one flange exhibiting an uninterrupted annular scraping edge. The proposed supporting ring may serve both to lodge and to maintain contact of the sheet metal scraper ring provided with scraping edge segments, and to provide the auxiliary seal effective when the machine is not running. In this instance, the radially outer or inner or both annular scraping edges may be in sealing contact with the end wall of the housing.

The axial contact force of the internal seal may be exerted by a spring pressing the supporting ring and scraper ring against the adjacent end wall of the housing. The spring may, for example, be a corrugated spring bearing against the bottom of the annular groove on one side and the back of the supporting ring and/or scraper ring on the other side.

In a further refinement of the invention, it is proposed that an annular diaphragm of resilient metallic material may be provided for sealing the scraper ring and/or the supporting ring in relation to one wall of the annular groove. The annular diaphragm may, for example, be L-shaped or U-shaped in cross-section and perform a twofold function as a sealing and spring member.

The proposed scraping edge segment may be either straight or convex outwardly. With a convex scraping edge segment a larger capacity for oil that has been stripped off can be achieved.

BRIEF DESCRIPTION OF THE DRAWINGS:

Embodiments of the invention will be illustrated below with reference to the drawings in which.

DETAILED DESCRIPTION

Figure 1:
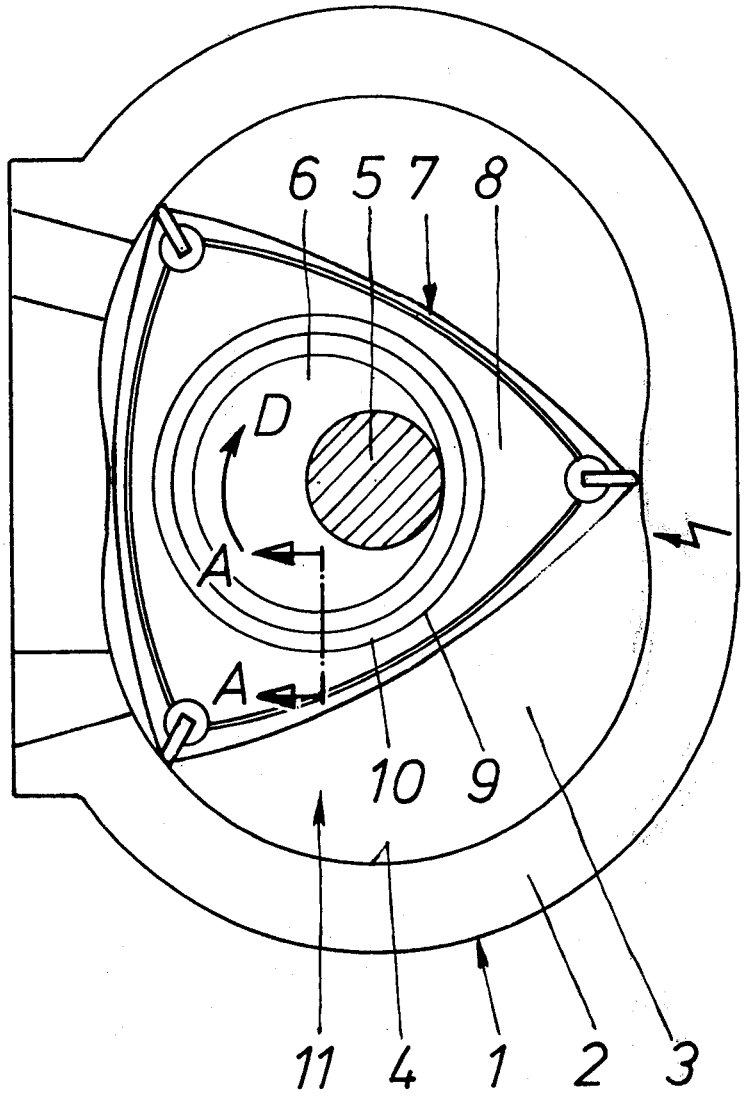
FIG. 1 is a schematic view of a rotary piston combustion engine of trochoid type with one end piece of the housing omitted.

Referring initially to FIG. 1, a rotary piston engine of trochoid type is represented having a housing 1 consisting of a shell 2 and two end pieces 3. The interior surface 4 of shell 2 has the shape of a biarcuate epitrochoid. The housing 1 is traversed by an eccentric shaft 5 on the eccentric 6 of which a piston 7 is rotatably mounted. Each face 8 of the piston carries an axial internal seal 10 in a concentric annular groove 9, pressed against the adjacent end wall 11 of the housing by spring action.

In order to prevent passage of coolant or lubricant from the region of the eccentric shaft 5 radially outwardly, the internal seals 10 are provided with at least one concentric scraping edge on the side towards the end wall 11 of the housing. As the piston 7 rotates in the direction of the arrow D, the internal seal 10 follows the motion described by the piston 7, scraping off oil adhering to the end wall 11 of the housing and bringing it radially inwardly.

Figure 2:
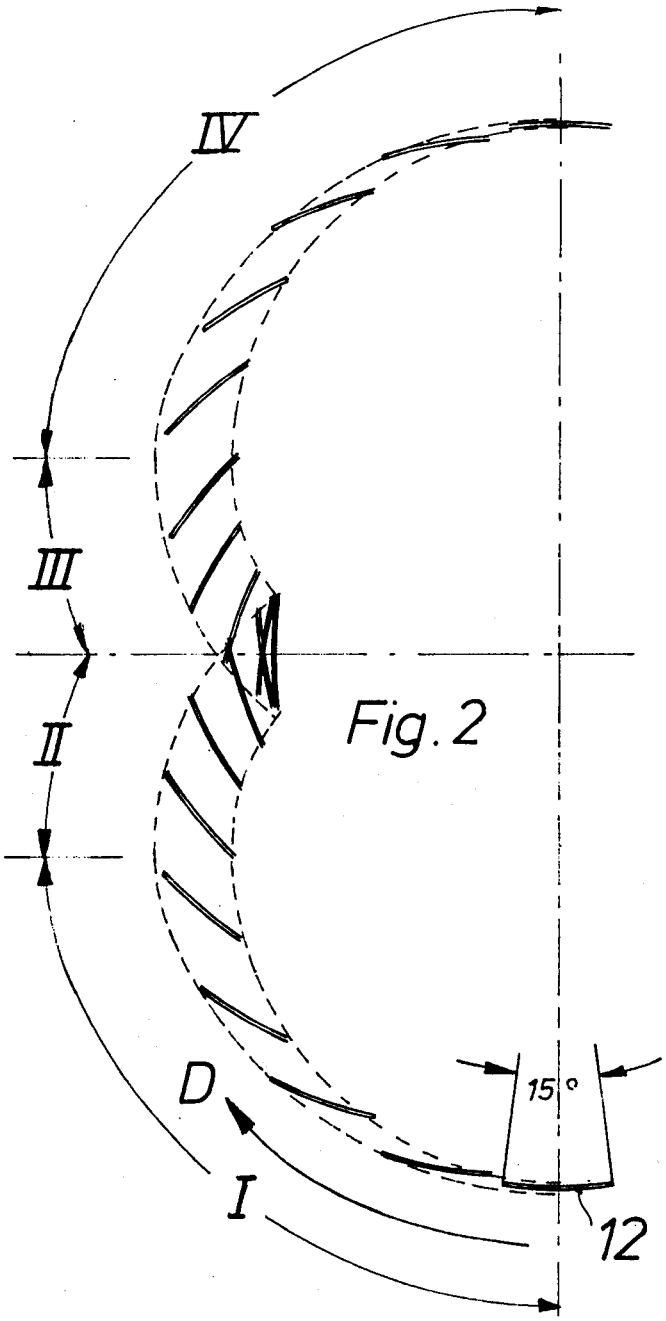
FIG. 2 shows the settings of a 15° sector of a conventional annular scraper ring at intervals of 30° eccentric shaft rotation over half a piston revolution.

FIG. 2 shows the movement executed by any 15° scraper ring sector 12 of an internal seal 10 by representing the positions occupied by the scraper ring in single steps of 30° eccentric shaft rotation each within half a piston revolution. The typical motion of a scraper ring sector 12 in the direction of the arrow D may thus be divided into four phases. In the phase marked I, the scraper ring sector 12 slips gradually inward, scraping a certain area of the end wall of the housing clear. It is only in phase II that the scraper ring sector 12 swings radially inwardly and can exert its main action, in phases III and IV, the sector 12 moves outwardly, and so must lift off from the end wall of the housing and run over any oil adhering to it. It is clear that the picture that each scraper ring sector 12, and hence the entire inner seal 10 sweeps equal areas of the end wall of the housing inwardly and outwardly. The effectiveness of such an internal seal is therefore determined largely by the form of the scraping edge.

Figure 3:
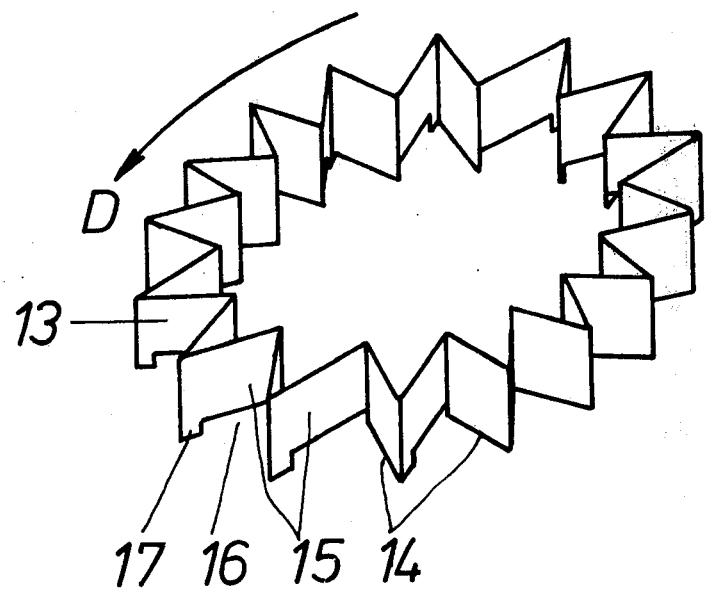
FIG. 3 is a pictorial representation of a scraper ring folded zig-zag according to the invention.

FIG. 3 shows a zig-zag folded scraper ring 13 whose elements directed obliquely outward in the direction of rotation D form scraping edge segments 14. Their neighboring elements 15 have a relief 16 such that the scraping edge segments 14 in contact with the end wall of the housing exhibit a hooked end 17. In rotation of the scraper ring 13 in direction D, the scraping edge segments 14 serve to transport the oil adhering to the end wall of the housing.

Figure 4:
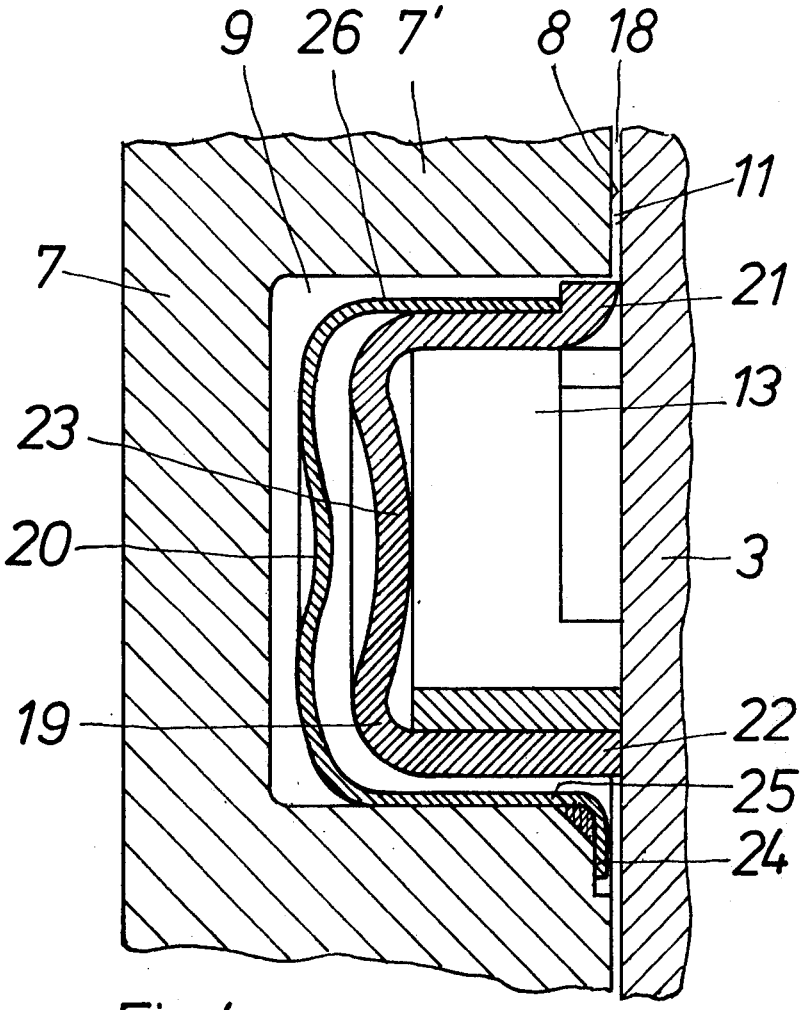
FIG. 4 is a section to a larger scale through a piston face of the one embodiment of an internal seal according to FIG. 3 taken along the line 4, 9, 14–4, 9, 14 in FIG. 1.

In FIG. 4, one side 7′ of the piston 7 has face 8 which bounds an annular space 18 together with the face 11 of the adjacent end piece 3 of the housing. In the wall 7′ of the piston, an annular groove 9 is provided in which an axially movable internal seal is inserted and consists of a scraper ring 13, a supporting ring 19 and a diaphragm ring 20. The scraper ring 13 is accommodated on its outer and inner peripheries by the two flanges 21 and 22 directed axially towards the end wall 11 of the housing; and it is centered and backed up on its reverse side in axial direction by a circumferential convexity 23 inside the supporting ring 19. The supporting ring 19 together with the scraper ring 13 is sprung against the end wall 11 of the housing by the diaphragm ring 20. The scraper ring 13 is able to bring back the oil adhering to the end wall 11 of the housing into the annular space 18 while the flange 21 or 22 or both together can form annular scraping edges with scrape ring action when the engine is not running. The spring action diaphragm ring 20 is for example U-shaped in cross-section, with a radially turned-in edge 24 resting on the face 8 of the piston. One adjacent peripheral wall 25 parallel to the axis is in sealing contact with one wall of the annular groove 25, and embraces the supporting ring 19. The outer peripheral wall 26 parallel to the axis is in sealing contact with the flange 21 of supporting ring 19 and also prevents passage of coolants or lubricants from the annular space 18 through the annular groove 9.

Figure 5:
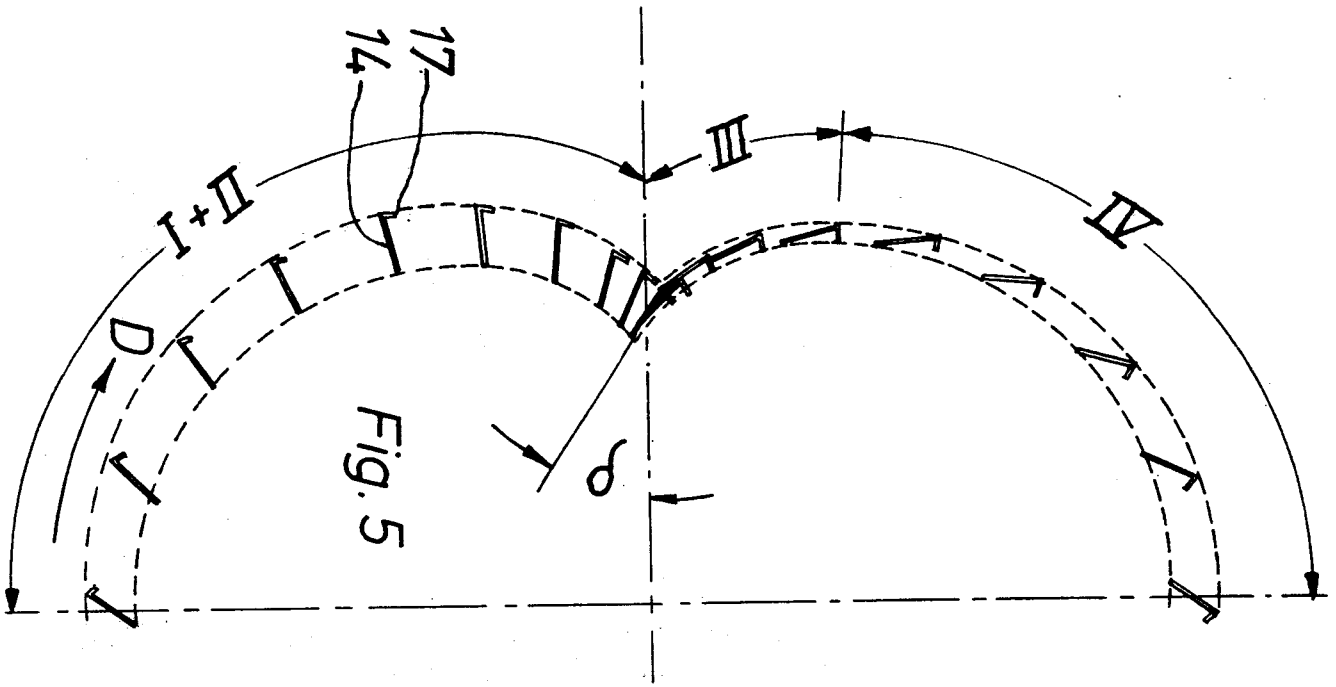
FIG. 5 shows the settings of an obliquely set scraper edge segment occupied by it at intervals at 30° eccentric shaft rotation over half a piston revolution.

FIG. 5 shows the cycle of motion of scraping edge segment 14 of an internal seal according to the invention, representing the positions it occupies (as in FIG. 2) in single steps of 30° eccentric shaft rotation each within half a piston revolution. It will be seen that the scraping edge segments 14 owing to their obliquity, sweep a region of end wall of approximately uniform width in phases I and II of their motion in the direction of rotation D. Oil stripped off may indeed creep radially outward along the scraping edge because of centrifugal action, but it will be retained by the hooked end 17 and carried along to the end of phase II, where the scraped off oil is detached from the scraping edge 14 by inertia upon change of direction at this point, and flows inward. In phase III the scraping edge segment 14 moves outward along an epitrochoid path. The obliquity of the scraping edge segments 14 is chosen such that they lie approximately tangential to the trajectory described in this region, so that in this phase III a very narrow area of end wall is swept, and but little oil is transported radially outward. In phase IV, likewise directed outward the scraping edge segment 14 again becomes operative as a transporting member. The picture shows that in the phase III directed radially outward, no oil is transported from the end wall of the housing, whereas in the further inward and outward motion, adhering oil can be scraped off the end wall of the housing and transported radially inward.

Figure 6:
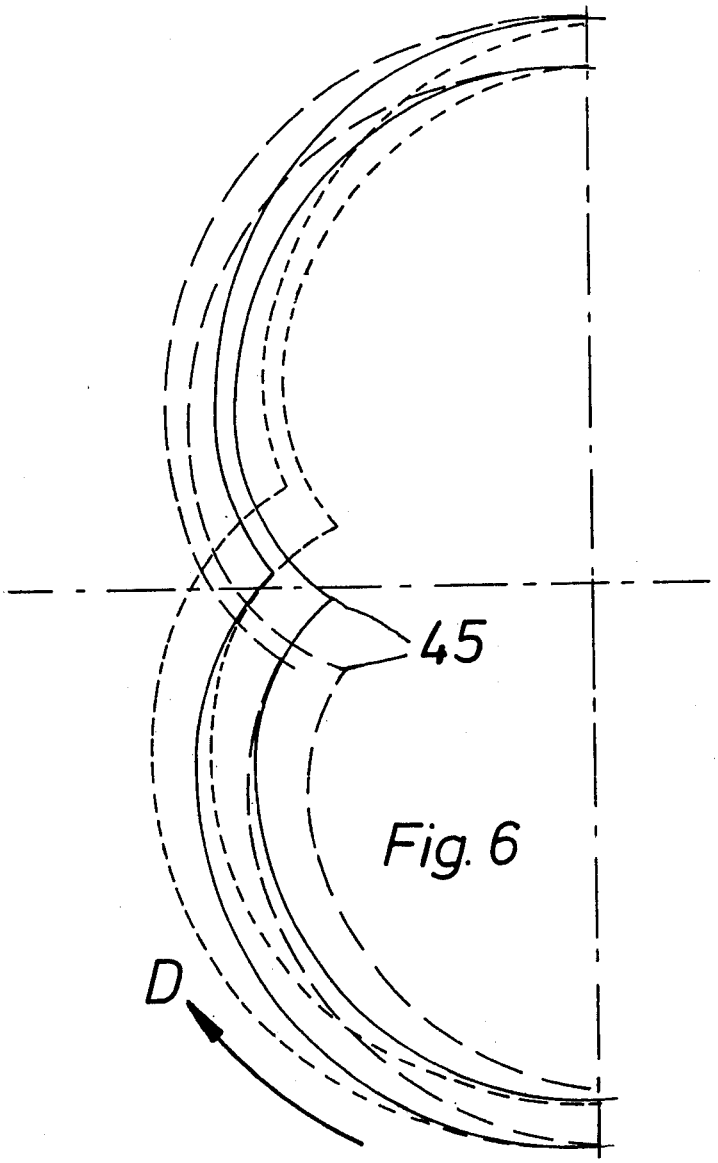
FIG. 6 shows the superposition of areas except by three scraping edge segments as in FIG. 5.

FIG. 6 shows how the end wall of the housing is swept by a scraper ring having for example three out of 24 obliquely set scraping edge segments over half a piston revolution in direction D. In FIG. 5, those positions are shown which the scraper ring occupies in single steps of 30° eccentric shaft rotation each. The phase III of FIG. 5 beginning at the position 45 nearest the axis during which the scraper ring does not do any transporting work, is in each instance traversed by the following scraping edge segments, so that oil is continually being scraped off the end wall of the housing throughout the region.

Figure 7:
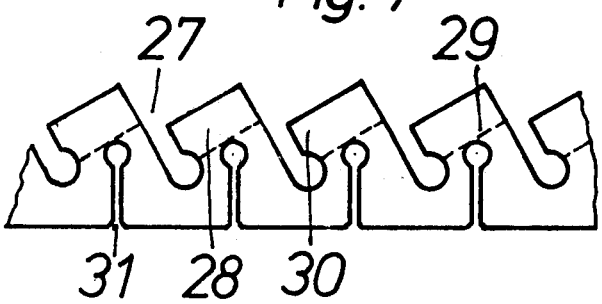
FIG. 7 is a partial view of a cut-out strip of material for a second embodiment of scraper ring.
Figure 8:
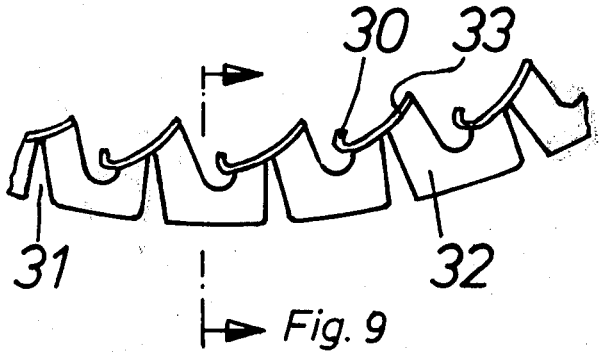
FIG. 8 is a partial view of a scraper ring formed out of a strip of material as in FIG. 7.

In the prefabricated strip of material shown in FIG. 7, oblique tabs 28 are formed by means or cut-outs 27. The obliquely set scraping edge segments are formed by turning over the projection 30 into a hooked end and bending the tabs 28 at the line 29. As FIG. 8 shows, the cut-outs 31 enable the strip of material to be formed into a scraper ring 32 according to the invention complete with scraping edge segments 33 and their hooked ends 30.

Figure 9:
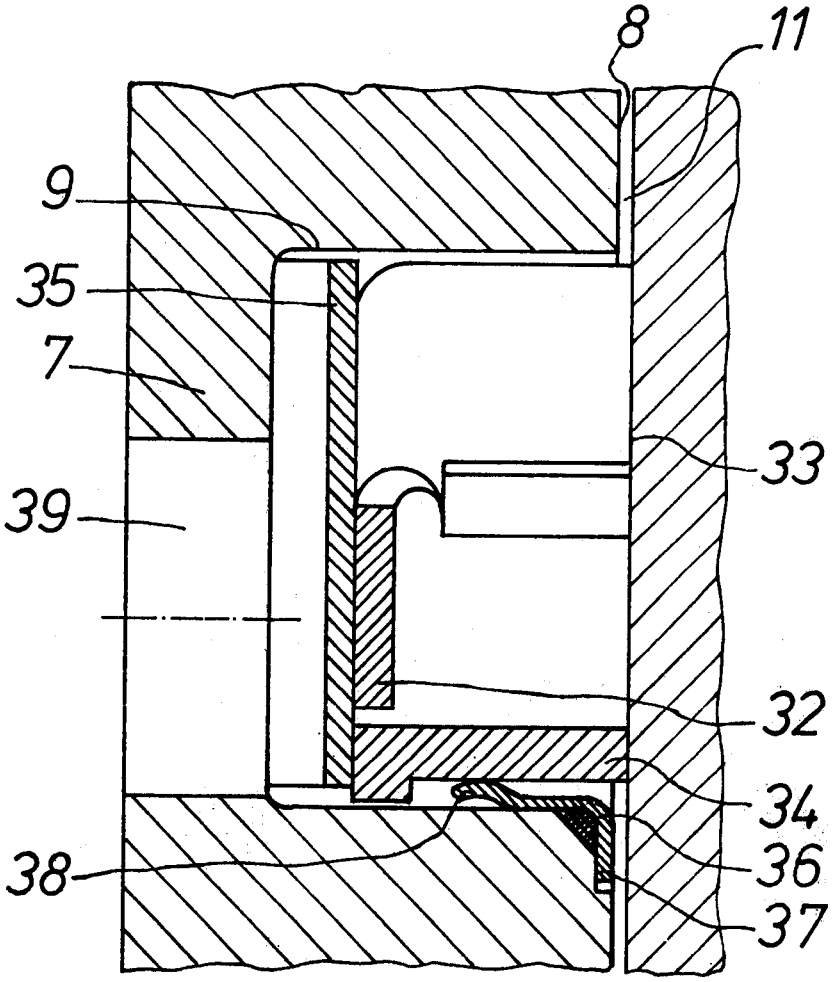
FIG. 9 is a section to a larger scale through a piston face and an internal seal according to FIG. 8 in a modified arrangement taken along the line 4, 9, 14–4, 9, 14 in FIG. 1.

In FIG. 9, the same reference numerals as in FIG. 4 have been used for like or similar parts. In departure from the embodiment of FIG. 4 a scraper ring 32 with scraping edge segments 33 as in FIGS. 7 and 8 and an auxiliary scraper ring 34 with an uninterrupted annular scraping edge, are pressed into contact with the end wall 11 of the housing in axial direction by a corrugated spring 35 inside the annular groove 9. For sealing within the annular groove 9, an L-shaped diaphragm ring 36 is provided, its radial flanges 37 bearing on the face 8 of the piston and its flange 38, directed axially into the annular groove 9 and having for example a circumferential sealing lip in sealing contact with one peripheral wall of the annular scraper ring 34. To return the oil scraped off the end wall 11 of the housing by the scraping edge segments 33 into the interior of the piston, additional oil return passages 39 may be arranged in the floor of the annular groove 9.

Figure 11:
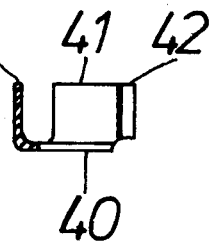
FIG. 11 is a cross-section of the scraper ring of FIG. 10.
Figure 10:
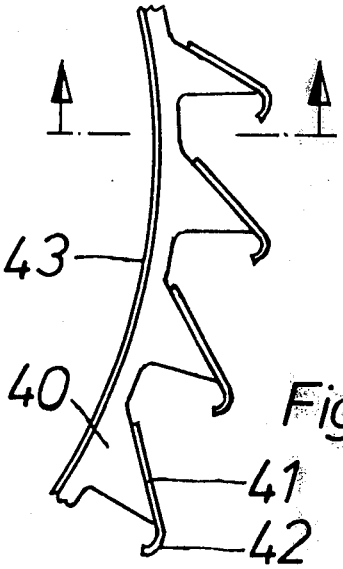
FIG. 10 is a partial view of a third embodiment of a scraper ring according to the invention.

FIG. 10 shows another embodiment of a scraper ring 40 according to the invention with obliquely set scraping edge segments 41 and their hooked ends 42, as well as an uninterrupted annular scraping edge 43 arranged radially within. The section shown in FIG. 11 shows how the scraper ring 40 may be of once connected piece.

Figure 13:
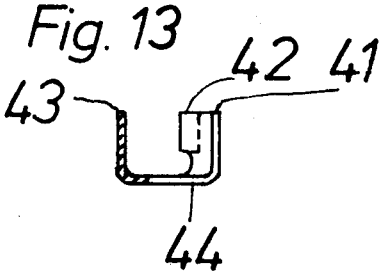
FIG. 13 is a cross-section of the scraper ring of FIG. 12.
Figure 12:
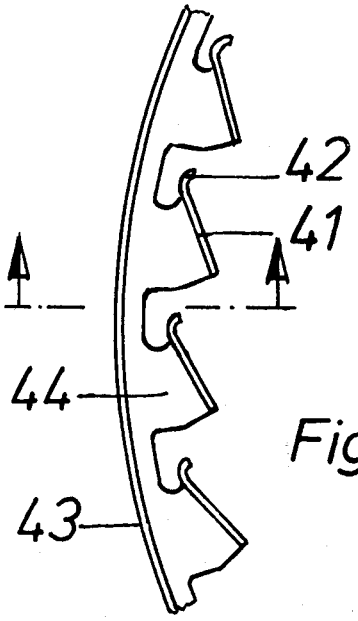
FIG. 12 is a partial view of a fourth embodiment of a scraper ring according to the invention.

FIG. 12 shows a scraper ring 44 produced in the same manner as the scraper ring represented in FIG. 10. In this embodiment, however, the uninterrupted annular scraper ring 43 lies radially without, while the obliquely set scraping edge segments 41 have their hooked ends 42 arranged radially within. As FIG. 13 also shows, the scraper ring 44 is made in one piece. The scraper ring 40 and 44 may consist either of solid stock or of sheet metal.

Figure 14:
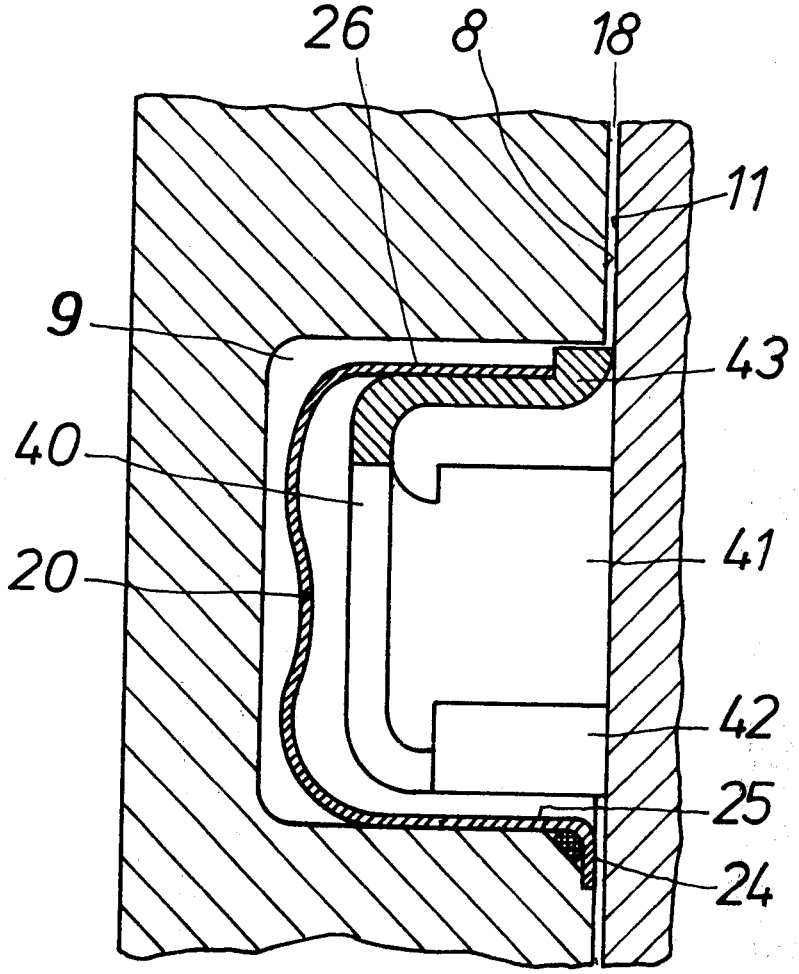
FIG. 14 is a section to a larger scale through a piston face and the internal seal as in FIG. 10 in another modified arrangement taken at the line 4, 9, 14–4, 9, 14 in FIG. 1.

In FIG. 14, the same reference numerals as in FIG. 4 have been used for like or similar parts. In departure from the embodiment of FIG. 4, for example, a scraper ring 40 is held in contact in axial direction with the end wall 11 of the housing by a spring diaphragm ring 20 inside the annular groove 9. The diaphragm ring 20 bearing firstly against the face 8 of the piston by a radial rim 24 and on one wall of the annular groove 9 by a circumferential wall 25 parallel to the axis, and secondly makes sealing contact with the periphery of the annular scraping edge 43 by its second peripheral wall 26 parallel to the axis. The diaphragm ring 20 performs a function as a spring element, and at the same time seals off the annular groove 9 from the annular space 18. The scraper ring 44 of FIG. 12 may be arranged in an annular groove 9 in similar manner.

Thus the several aforenoted objects and advantages are most effectively attained. Although several somewhat preferred embodiments have been disclosed and described in detail herein, it should be understood that this invention is in no sense limited thereby and its scope is to be understood by that of the appended claims.

What is claimed is:

1. An internal seal for the piston of a rotary piston engine or trochoid type with a housing having two end pieces and a shell with multi-arcuate interior surface in which the piston is rotatably mounted on the eccentric of an eccentric shaft, said internal seal having at least one scraper ring arranged axially movable to a concentric annular groove in one face of the piston, said scraper ring is axially movable and adapted to revolve with the piston while being pressed against the adjacent end wall of the housing by spring action, said scrpaer ring comprising spaced scraping edge segments uniformly distributed over the circumference of the scraper ring and adapted to be in contact with the adjacent end wall of the housing, which segments are set obliquely radially outwardly in the direction of rotation of the piston, and the segments being a plurality of individual elastic scraper edge portions of sheet metal.

2. An internal seal according to claim 1, wherein such scraper ring segment is so arranged that in its outward movement from its position nearest the axis, it stands approximately tangential to the epitrochoid described by it.

3. An internal seal according to claim 1, wherein the scraping edge segments of the scraper ring each exhibit a hook-shaped projection directed radially inwardly at their radially outer ends.

4. An internal seal according to claim 1, wherein the scraper ring is a flat strip of metal folded zig-zag.

5. An internal seal according to claim 1, wherein the scraper ring is a flat ring, and the scraping edge segments are formed by rib-like elevations on one face of said ring.

6. An internal seal according to claim 1, wherein the scraper ring is a flat ring having tabs separated from each other by indentations on one of its edges, which tabs run perpendicular to the plane of the ring towards the adjacent end wall of the housing and their outer edges being directed oblique to the direction of rotation of the piston and forming the scraping edge segments.

7. An internal seal according to claim 1, wherein an annular diaphragm of resilient metallic material seals at least one of the scraper rings adjacent one wall of the annular groove.

8. An internal seal according to claim 1, wherein the scraper ring has an uninterrupted annular scraping edge radially offset relative to the scraping edge segments.

9. An internal seal according to claim 8, wherein the ring is of sheet metal and one of the edges of the sheet metal ring is turned up towards the adjacent end wall of the housing to form the uninterrupted annular scraping edge.

10. An internal seal according to claim 1, wherein the scraper ring with its scraping edge segments is arranged in a supporting ring of U-shaped cross-section open towards the adjacent end wall of the housing, at least one of the legs of the legs of the U exhibiting an uninterrupted annular scraping edge.

11. An internal seal according to claim 9, wherein a spring presses the supporting ring with scraper ring into contact with the adjacent end wall of the housing.

12. An internal seal according to claim 10, wherein an annular diaphragm of resilient metallic material seals at least one of the supporting rings adjacent one wall of the annular groove.

* * * * *